US012644264B2

(12) United States Patent
Compton

(10) Patent No.: US 12,644,264 B2
(45) Date of Patent: Jun. 2, 2026

(54) LOW PROFILE DRAIN WITH WATER TRAP

(71) Applicant: Robert Thomas Compton, Wichita, KS (US)

(72) Inventor: Robert Thomas Compton, Wichita, KS (US)

( * ) Notice: Subject to any disclaimer, the term of this patent is extended or adjusted under 35 U.S.C. 154(b) by 67 days.

(21) Appl. No.: 18/286,550

(22) PCT Filed: Apr. 12, 2022

(86) PCT No.: PCT/US2022/024386
§ 371 (c)(1),
(2) Date: Oct. 11, 2023

(87) PCT Pub. No.: WO2022/221257
PCT Pub. Date: Oct. 20, 2022

(65) Prior Publication Data

US 2024/0200317 A1 Jun. 20, 2024

Related U.S. Application Data

(60) Provisional application No. 63/174,012, filed on Apr. 12, 2021.

(51) Int. Cl.
*E03C 1/29* (2006.01)

(52) U.S. Cl.
CPC ..... *E03C 1/29* (2013.01)

(58) Field of Classification Search
CPC ..... E03C 1/29; E03F 5/0407
USPC ..... 4/679, 378, 584, 613, 650, 668; 285/134.1; 137/241.41, 362, 577
See application file for complete search history.

(56) References Cited

U.S. PATENT DOCUMENTS

| | | | | |
|---|---|---|---|---|
| 1,751,877 | A | 3/1930 | Nance | |
| 2,616,094 | A | 11/1952 | Cramer | |
| 4,275,760 | A | 6/1981 | Kessel | |
| 4,655,018 | A * | 4/1987 | Pardo | E04D 11/00 52/302.3 |
| 5,192,156 | A | 3/1993 | Webb | |
| 5,282,438 | A | 2/1994 | McLaughlin | |
| 7,919,002 | B1 | 4/2011 | Hurtado | |

(Continued)

FOREIGN PATENT DOCUMENTS

| | | | |
|---|---|---|---|
| DE | 1969082 | U | 9/1967 |
| EP | 1464768 | A2 | 10/2004 |

(Continued)

OTHER PUBLICATIONS

International Search Report and Written Opinion for PCT/US2022/024386 mailed Apr. 12, 2022.

(Continued)

*Primary Examiner* — Lori L Baker
(74) *Attorney, Agent, or Firm* — Crowe & Dunlevy, P.C.

(57) ABSTRACT

A water trap for use in connection with a wash basin or other plumbing fixture includes a housing, an inlet extending into the housing and an outlet extending out of the housing. The water trap also includes a weir inside the housing between the inlet and the outlet, and a trap chamber defined by the space within the housing on an upstream side of the weir. The trap chamber is designed to retain liquid following a drain cycle from the wash basin or other plumbing fixture.

14 Claims, 11 Drawing Sheets

(56) References Cited

U.S. PATENT DOCUMENTS

| | | | | |
|---|---|---|---|---|
| 11,692,335 | B2 * | 7/2023 | McAlpine | E03C 1/182 4/679 |
| 11,732,827 | B1 * | 8/2023 | Nashed | E03C 1/122 4/679 |
| 11,761,564 | B2 * | 9/2023 | Grayson | E03C 1/284 4/679 |
| 2004/0177439 | A1 | 9/2004 | Nunez | |
| 2009/0288349 | A1 * | 11/2009 | Wootton | E04D 13/076 52/12 |
| 2010/0051308 | A1 * | 3/2010 | Hansen | H02G 3/185 174/50.5 |
| 2011/0067174 | A1 | 3/2011 | Schaefer et al. | |
| 2013/0025046 | A1 | 1/2013 | Yu et al. | |
| 2015/0202507 | A1 * | 7/2015 | Timberman | A63B 57/50 473/408 |
| 2017/0241144 | A1 * | 8/2017 | Schlyter Gezelius | B32B 7/03 |
| 2023/0228078 | A1 * | 7/2023 | Egli | A47K 3/405 4/613 |
| 2023/0235545 | A1 * | 7/2023 | Duban | E03F 5/0404 4/679 |
| 2023/0313512 | A1 * | 10/2023 | Kondo | E03D 1/36 4/378 |

FOREIGN PATENT DOCUMENTS

| | | | |
|---|---|---|---|
| EP | 1544360 | A1 | 6/2005 |
| EP | 1566497 | B1 | 10/2009 |
| EP | 2540202 | A2 | 1/2013 |
| EP | 2228497 | B1 | 3/2018 |
| GB | 1518466 | A | 7/1978 |
| GB | 2298661 | A | 9/1996 |

OTHER PUBLICATIONS

Extended European Search Report for EP 22788758.5 mailed Jan. 27, 2025.

* cited by examiner

LOW PROFILE DRAIN WITH WATER TRAP

RELATED APPLICATIONS

This application claims the benefit of U.S. Provisional Patent Application Ser. No. 63/174,012 filed Apr. 12, 2021 entitled, "Low Profile Drain with Water Trap," the disclosure of which is herein incorporated by reference.

FIELD OF THE INVENTION

The present invention is generally directed at plumbing fixtures, and more particularly, but not by way of limitation, to an improved water trap for use in connection with a drain.

BACKGROUND

Traps or "water traps" are commonly used to prevent sewer gases from traveling upward from the sewer or septic system through drains located in kitchens, bathrooms or other indoor facilities. In domestic applications, traps are typically configured as "U," "S," "Q" or "J" shaped pipes that are located below or within a plumbing fixture. In the United States, water traps are commonly referred to as "P-traps," and include a right angle turn on the exit of a U-shaped bend (thus forming a horizontally oriented "P").

A conventional P-trap 200 is depicted in the PRIOR ART drawing of FIG. 1. The P-trap 200 includes an inlet 202, a U-bend 204, a crown 206, and an outlet 208. In most applications, the outlet 208 is disposed in a substantially horizontal orientation and the inlet 202 is disposed in a substantially vertical orientation. During use, water or other liquids enter the inlet 202 from an upstream fixture 210 (such as a sink), flow through a fixture drain pipe 212 into the P-trap 200, where the liquid flows through the inlet 202 and U-bend 204 before exiting the P-trap 200 through the outlet 208. Following a drain cycle, a small volume of water or other liquid is retained in the portion of the U-bend 204 below the outlet 208. The residual water in the U-bend 204 forms a "water seal" that prevents gases from passing upward from the sewer through the P-trap 200.

Although widely adopted, the conventional P-trap 200 suffers from several deficiencies. First, the P-trap 200 requires a significant vertical drop between the fixture 210 and the bottom of the U-bend 204. The space required for the conventional P-trap 200 creates design restrictions that can be particularly problematic when designing plumbing connections for fixtures 210 that are capable of accommodating access by wheelchair. The P-trap 200 suspended below a sink 210 presents aesthetic and clearance issues that limit functional applications and obstruct accessibility to the sink and faucet especially with regard to wheelchair access. There is, therefore, a need for an improved water trap that overcomes these and other deficiencies of the prior art.

SUMMARY OF THE INVENTION

Exemplary embodiments disclosed herein include a water trap for use in connection with a wash basin or other plumbing fixture. The water trap has a housing, an inlet extending into the housing, an outlet extending out of the housing, a weir inside the housing between the inlet and the outlet, and a trap chamber defined by the space within the housing on an upstream side of the weir. The trap chamber is designed to retain liquid in a substantially horizontal chamber following a drain cycle from the wash basin or other plumbing fixture.

In another embodiment, the present disclosure is directed to a water trap for use in connection with a floor drain. In this embodiment, the water trap includes a housing, an exterior grate on the top of the housing, a deflector plate under the exterior grate, an inlet baffle connected to a distal end of the deflector plate, an intake channel between the inlet baffle and the housing, an outlet extending from the housing, a weir inside the housing between the inlet baffle and the outlet, and a trap chamber defined by the space within the housing on an upstream side of the weir. The trap chamber is designed to retain liquid following a drain cycle from the floor drain.

In yet another embodiment, this disclosure is directed to a water trap for use in connection with an integrated wash basin. In this embodiment, the water trap includes a housing, a deflector plate on top of the housing, an inlet baffle connected to a distal end of the deflector plate, an intake channel between the inlet baffle and an end wall of the housing, an outlet extending from the housing, a weir inside the housing between the inlet baffle and the outlet, and a trap chamber defined by the space within the housing on an upstream side of the weir. The trap chamber is designed to retain liquid following a drain cycle from the integrated wash basin.

WRITTEN DESCRIPTION

Figure 1:
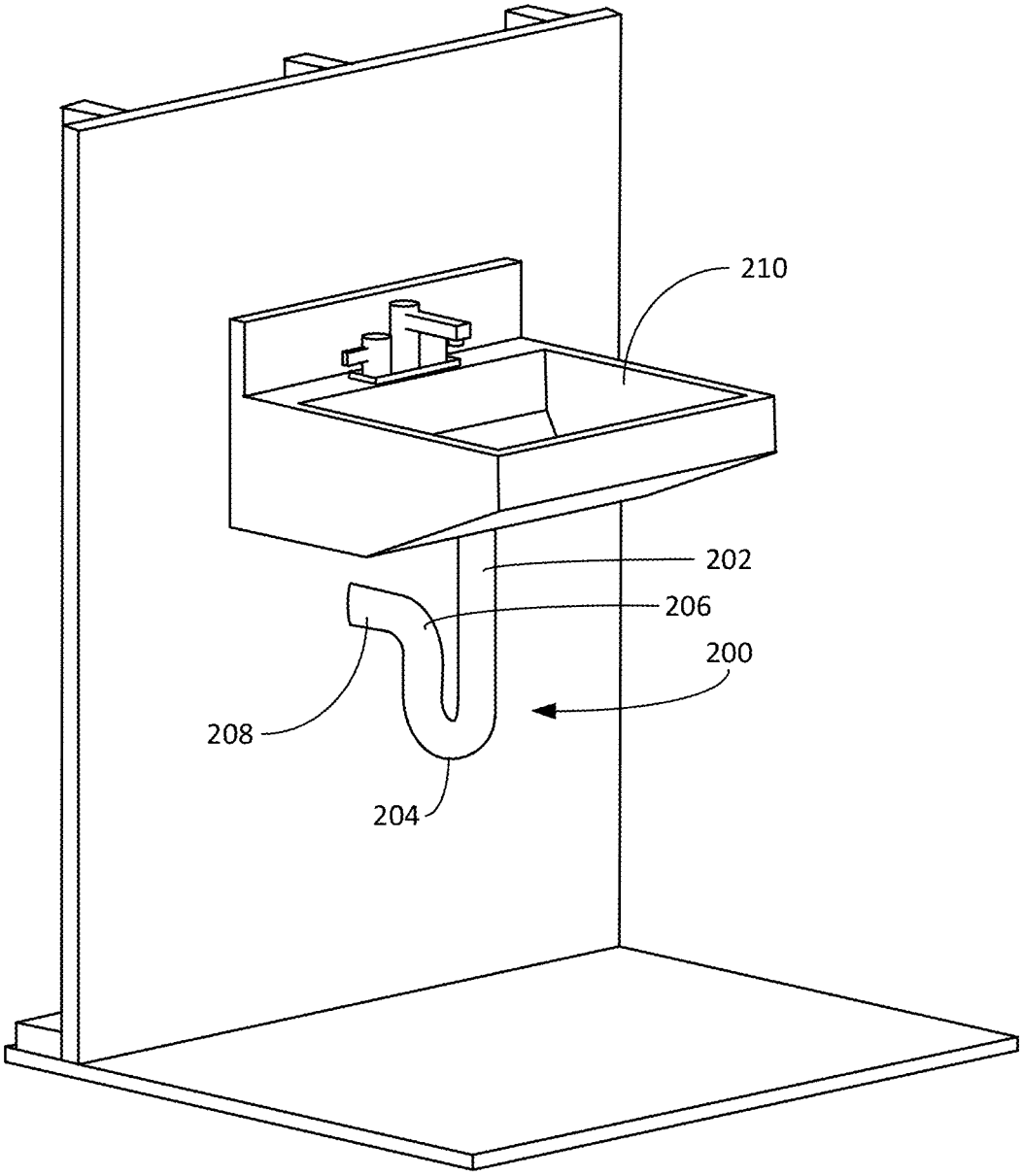
FIG. 1 PRIOR ART
FIG. 1 is a perspective view of a PRIOR ART P-trap installation on a wash basin.
Figure 2:
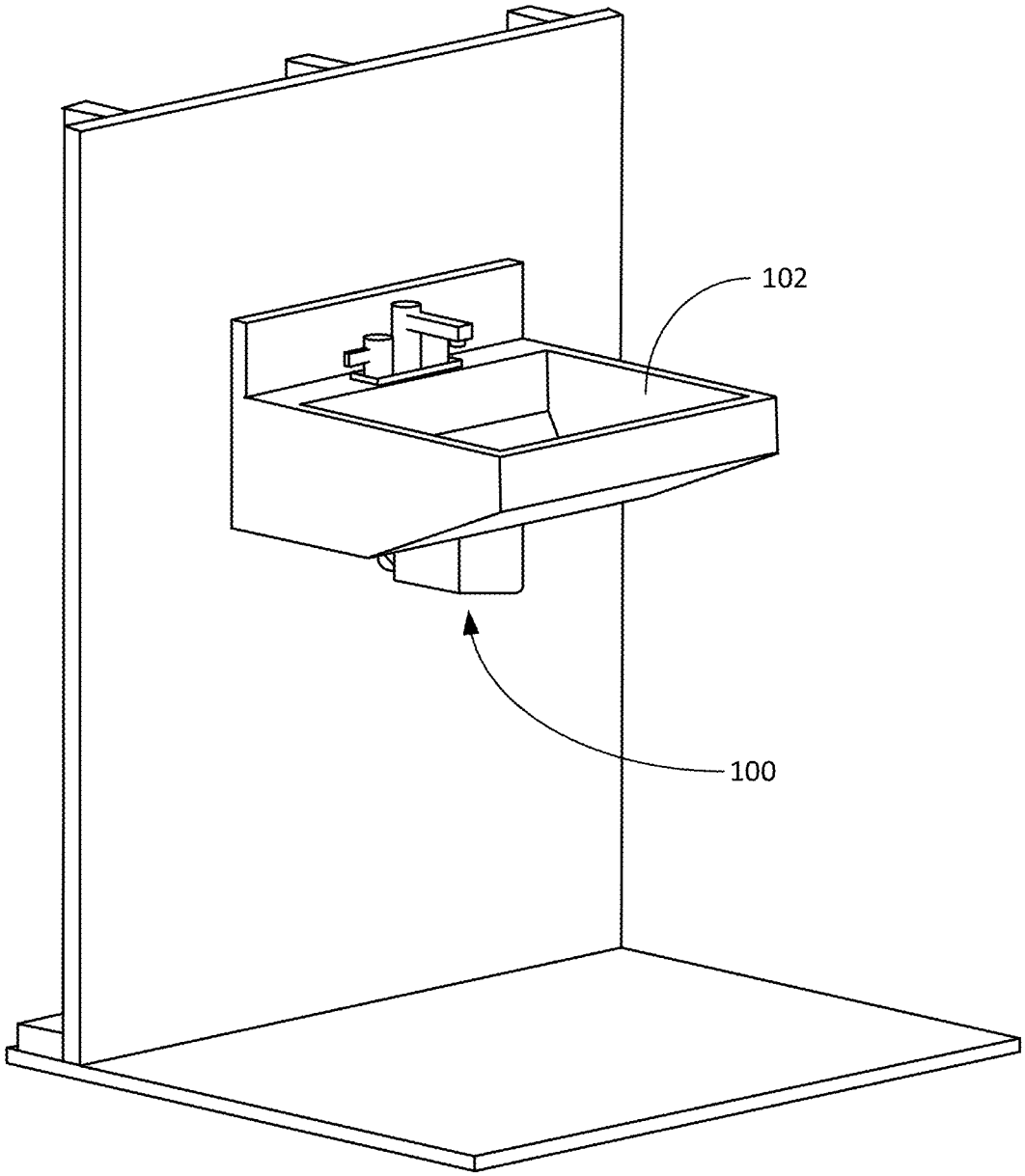
FIG. 2 is a perspective view of a wash basin installation of a water trap constructed in accordance with a first embodiment of the present invention.
Figure 3:
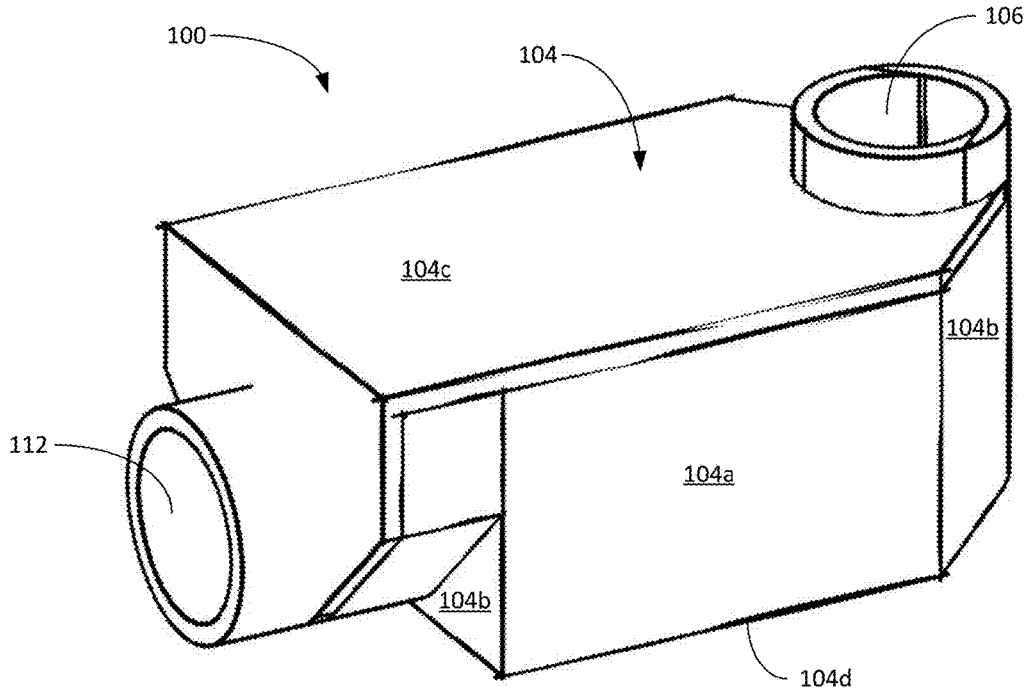
FIG. 3 is a perspective view of the water trap depicted in FIG. 2.
Figure 4:
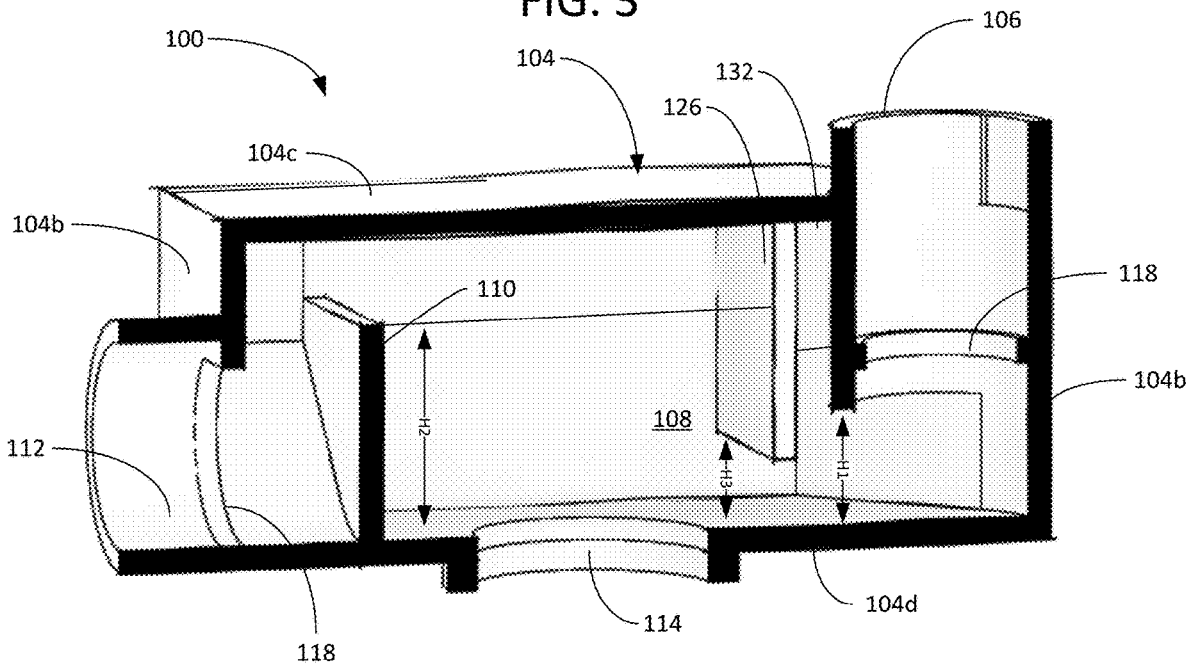
FIG. 4 is a cross-sectional view of the water trap of FIG. 3.
Figure 5:
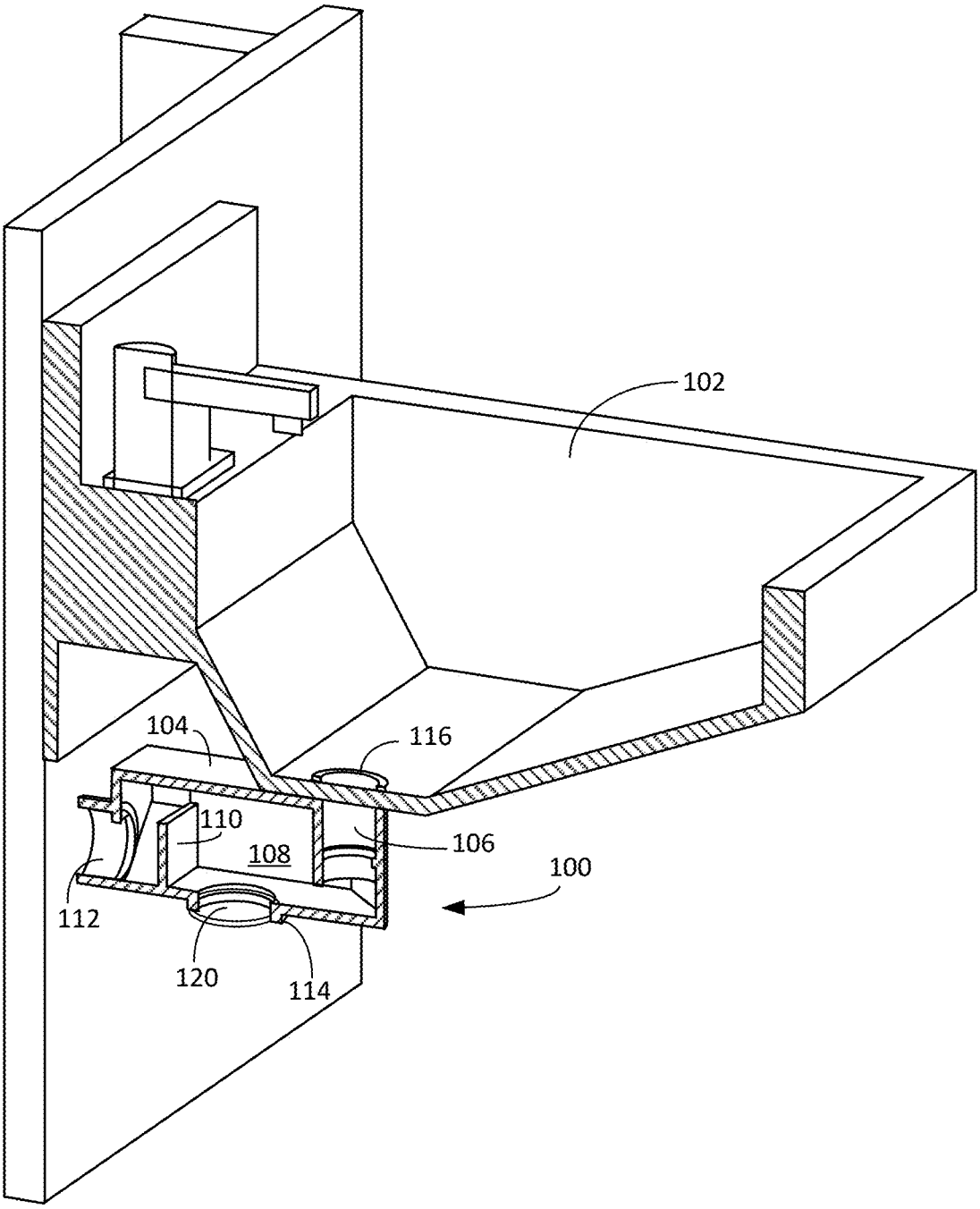
FIG. 5 is a cross-sectional view of a wash basin installation of the water trap of FIG. 2.

Referring first to FIGS. 2-5, shown therein are various depictions of a water trap 100 constructed in accordance with a first embodiment. In FIGS. 2 and 5, the water trap 100 is depicted in connection with an installation on the drain of a wash basin 102. In the embodiment depicted in FIGS. 2-5, the water trap 100 includes a housing 104, an inlet 106, an internal trap chamber 108, a weir 110, an outlet 112, and a cleanout port 114. Although the covered embodiments are not so limited, the housing 104 generally resembles an irregular box that includes closed side walls 104*a*, end walls 104*b*, a top 104*c* and a bottom 104*d*. The water trap 100 is connected to a basin drain 116 below the wash basin 102 such that gravity will draw liquid out of the basin drain 116 of the wash basin 102 into the water trap 100. As used herein, the terms "upstream" and "downstream" are used as relational descriptors for identifying components or portions of the water trap 100 according to the intended flow of liquids through the water trap 100 (i.e., from the inlet 106, through the trap chamber 108, to the outlet 112). Thus, by way of example, the trap chamber 108 and weir 110 are "downstream" from the inlet 106 and "upstream" from the outlet 112.

The inlet 106 is tubular and extends into the housing 104 through the top 104*c* of the water trap 100. The inlet 106 has a first end connected directly or indirectly to the basin drain 116 and a second "discharge" end located inside the water trap 100 at a height (h1) above the bottom 104*d* of the housing 104. The space between the second end of the inlet 106 and the bottom 104*d* of the housing 104 permits liquids to enter the trap chamber 108 from the inlet 106. The inlet 106 can be oriented in a substantially vertical position.

The outlet 112 is also tubular and extends into the housing 104 through an end wall 104*b* on an opposite side of the water trap 100 from the inlet 106. The outlet 112 is oriented in a substantially horizontal position at, or adjacent to, the bottom 104*d* of the housing 104. The housing 104 may include a V-shaped or U-shaped funnel section near the outlet 112 (as depicted in FIGS. 3-4) to encourage thorough removal of liquids from the water trap 100 through the outlet 112. The inlet 106 and outlet 112 may include internal flanges 118 to facilitate connection with upstream and downstream piping or other connections. The outlet 112 is lower than the inlet 106 to allow gravity to pull liquids through the water trap 100. In some applications, the inlet 106 and outlet 112 are configured for slip, threaded and compression fittings. As used herein, the term "tubular" refers to a member with a hollow interior, including members with circular and rectangular cross-sections.

The cleanout port 114 includes a removable plug 120 (shown in FIG. 5) that can be configured for a threaded connection with the cleanout port 114. The removal of the plug 120 from the cleanout port 114 permits direct access to the internal trap chamber 108 for servicing the water trap 100. In exemplary embodiments, the water trap 100 is manufactured using composite materials or polymers, such as polyvinyl chloride (PVC). In other applications, the water trap 100 can be constructed from ceramic materials or metals, such as stainless steel, aluminum or copper.

The trap chamber 108 is located inside the housing 104 and defined by the space within the housing 104 on the upstream side of the weir 110. As depicted in the cross-sectional views in FIGS. 4-5, the weir 110 is a substantially vertical component that acts as a wall to separate the trap chamber 108 from the downstream outlet 112. The weir 110 has a height (h2) that is greater than the height (h1) between the inlet 106 and the bottom 104*d* of the housing 104. The height (h2) of the weir 110 defines the depth of the trap chamber 108 within the housing 104. In this way, the water trap 100 provides a substantially horizontal trap chamber 108.

During use, liquid enters the water trap 100 through the inlet 106 and fills the trap chamber 108 until the volume of liquid in the water trap 100 exceeds the volume of the trap chamber 108. The liquid then flows over the weir 110 and exits the water trap 100 through the outlet 112. Once the liquid from an upstream source is no longer flowing, the water trap 100 maintains a volume of liquid in the trap chamber 108 with an initial depth that is substantially the same as the height (h2) of the weir 110. Because the discharge of the inlet 106 is below the top of the weir 110, the discharge end of the inlet 106 remains submerged when the trap chamber 108 contains liquid at a depth greater than (h1). This prevents any sewer gases entering the water trap 100 from the outlet 112 from passing upward through the inlet 106. In this way, the liquid retained within the trap chamber 108 acts as a water seal to prevent gases from passing upward through the water trap 100.

As depicted in FIG. 4, the water trap 100 optionally includes an inlet baffle 126 that extends downward from the top of the housing 104*c* into the trap chamber 108. The lower end of the inlet baffle 126 is spaced apart from the bottom 104*d* of the housing 104 by a height (h3), which is the same or less than the height (h1) between the housing bottom 104*d* and the bottom of the inlet 106. The optional inlet baffle 126 reduces turbulence and increases the performance of the liquid seal provided by fluid inside trap chamber 108 by reducing the amount of liquid within the trap chamber 108 needed to prevent sewer gases from passing through the trap chamber 108. As long as the level of fluid in the trap chamber 108 is higher than the height (h3) of the space between the inlet baffle 126 and the housing bottom 104*d*, the retained liquid inside the trap chamber 108 will prevent gases from passing through the inlet 106. Moreover, the optional inlet baffle 126 creates an air pocket 132 in the space between the inlet 106 and the inlet baffle 126. During use, the air inside the air pocket 132 is pressurized by the rising liquid level in the trap chamber 108. The increased pressure of the air within the air pocket 132 lowers the liquid level on the inlet side of the inlet baffle 126 compared to the outlet side of the inlet baffle 126 (which is exposed to atmospheric pressure through the trap discharge pipe 216. Without the inlet baffle 126 and air pocket 132, the liquid level in the trap chamber 108 should equalize on either side of the inlet 106.

The water trap 100 provides a number of advantages over common P-traps. The volume of the trap chamber 108 is larger than conventional P-traps. This increases the effectiveness of the water trap 100 by reducing the risk that water in the trap chamber 108 evaporates between drain cycles. Because the trap chamber 108 is substantially horizontal, the water trap 100 requires less vertical space under the wash basin 102, which facilitates installation in wheelchair accessible applications, while also improving storage space and aesthetics. The water trap 100 is also easier to service than conventional P-traps. Rather than removing the entire P-trap, the water trap 100 can be cleaned by simply removing the plug 120 from the cleanout port 114.

Figure 6:
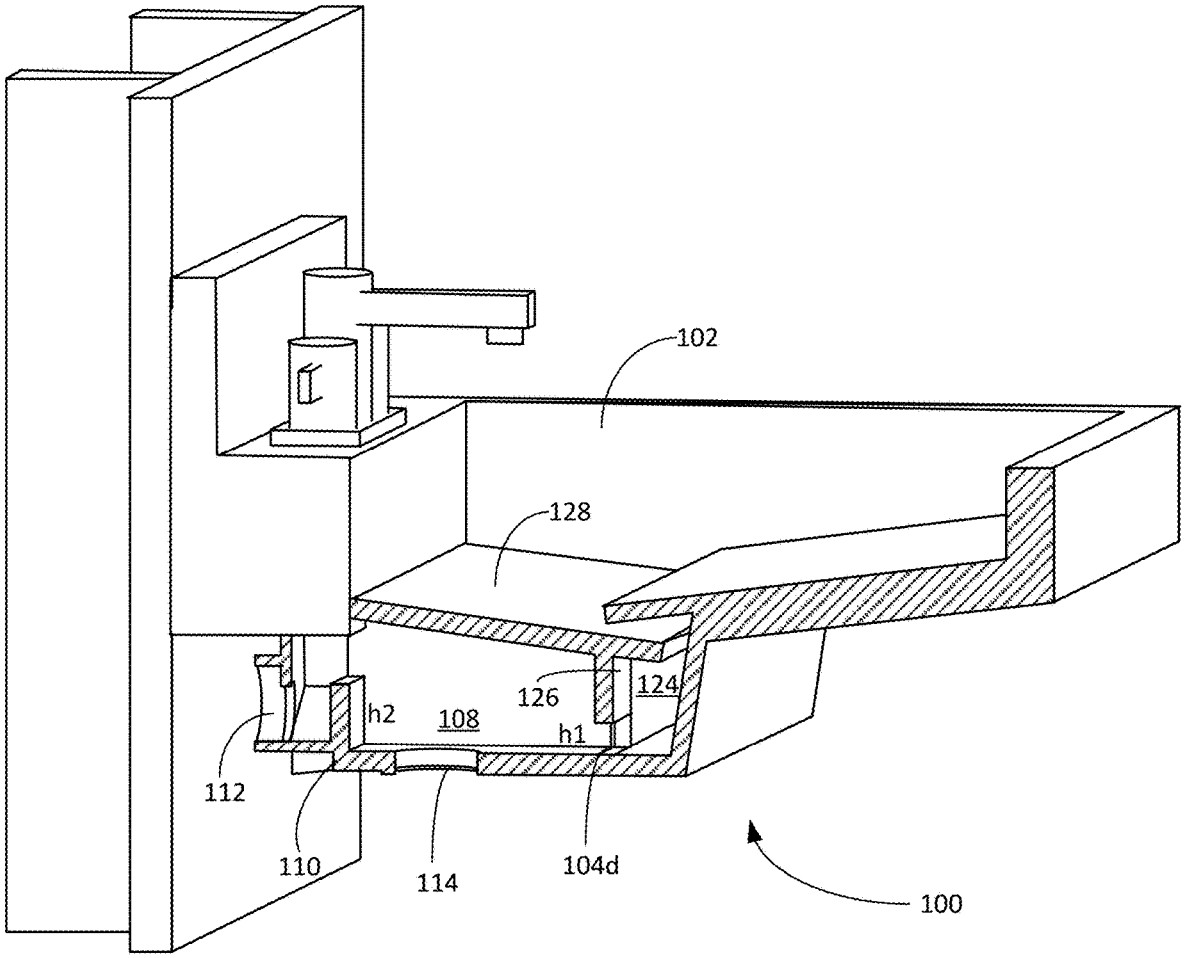
FIG. 6 is a cross-sectional view of a water trap constructed in accordance with a second embodiment in which the water trap is integrated into the wash basin.
Figure 7:
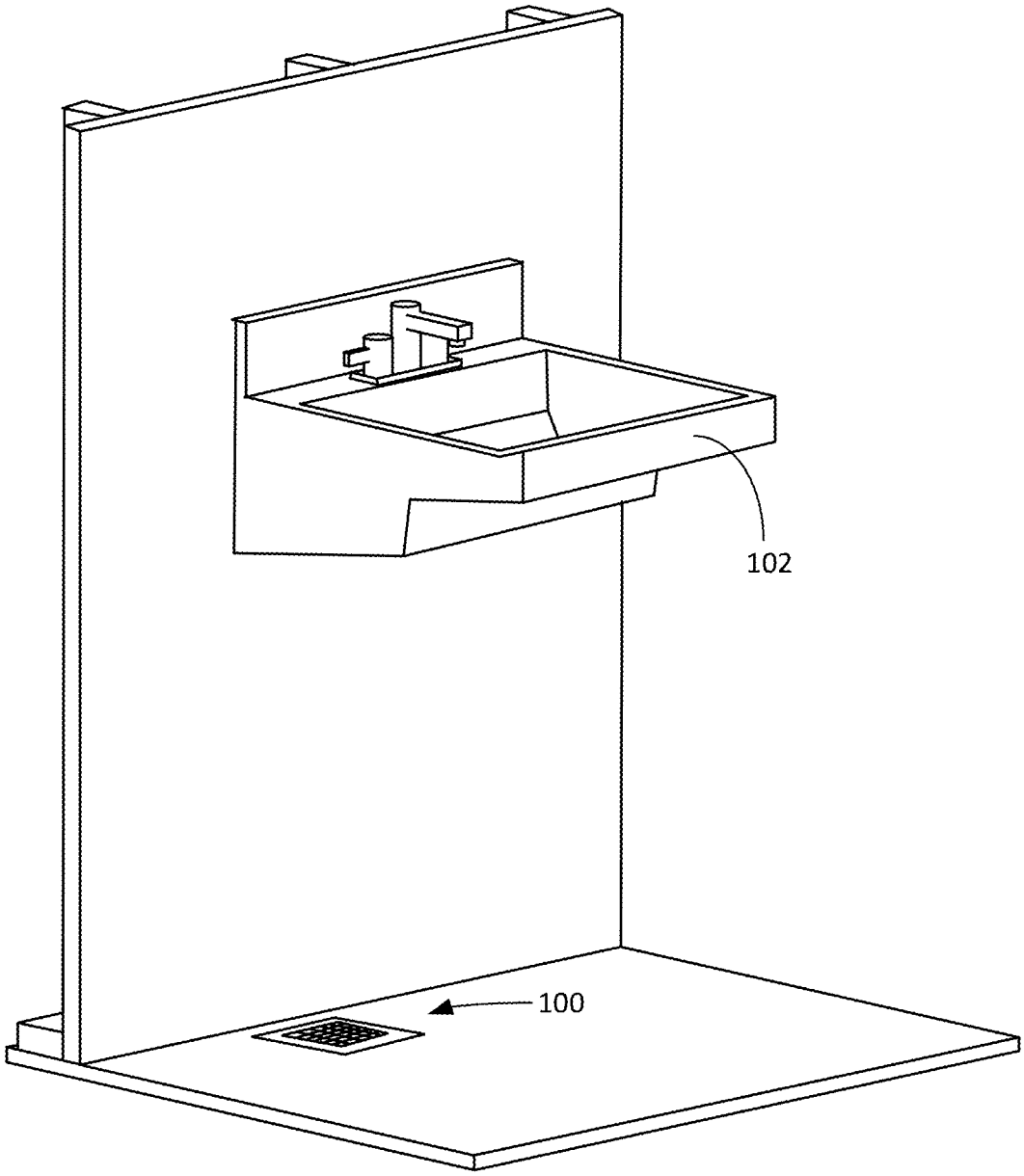
FIG. 7 is a perspective view of a floor drain installation of a water trap constructed in accordance with a third embodiment of the present invention.
Figure 8:
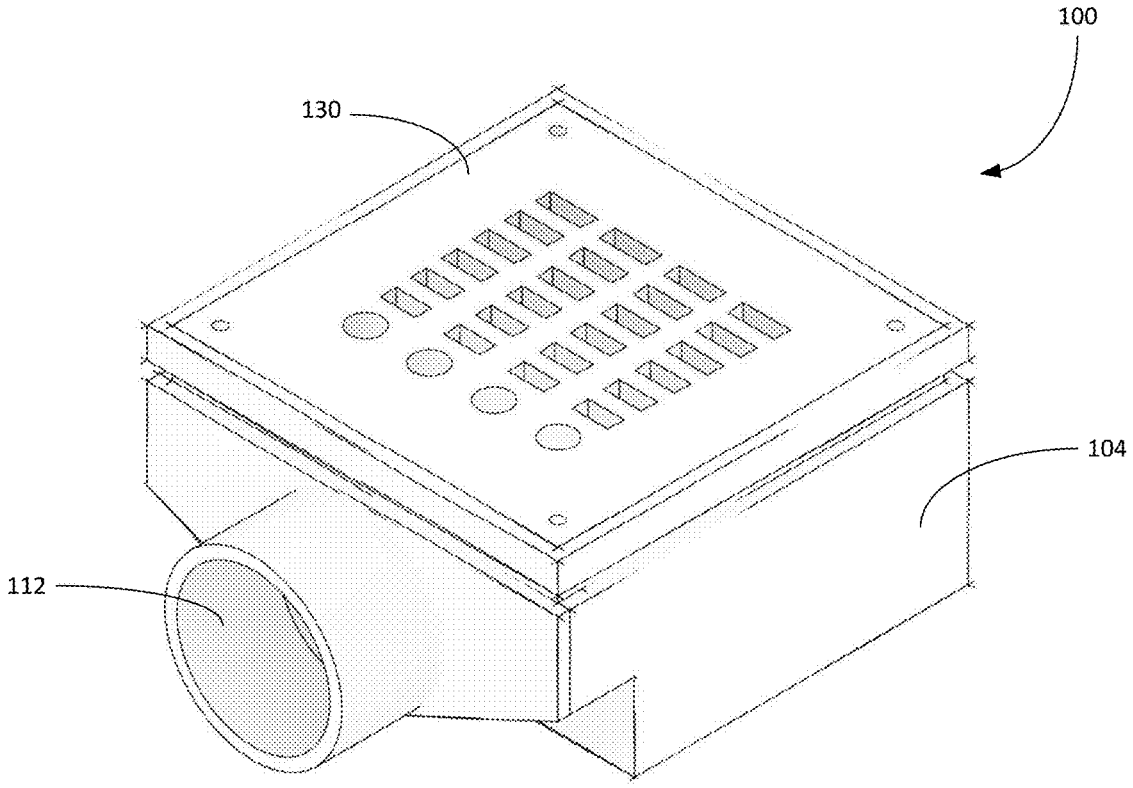
FIG. 8 is a perspective view of the floor drain water trap of FIG. 7.
Figure 9:
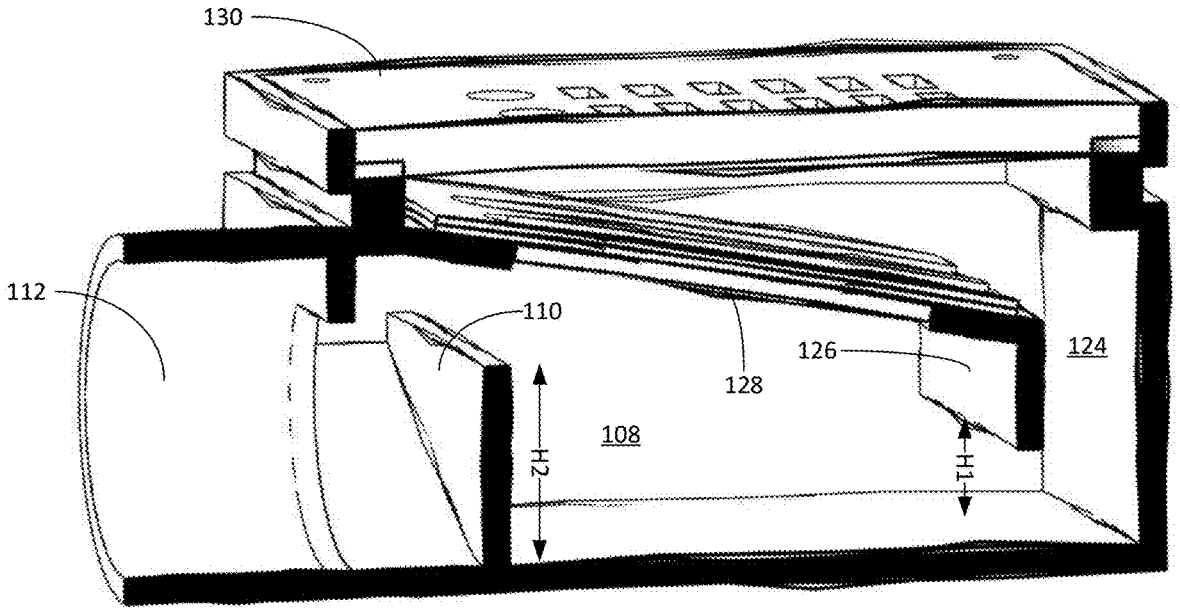
FIG. 9 is a cross-sectional view of the water trap of FIG. 8.
Figure 10:
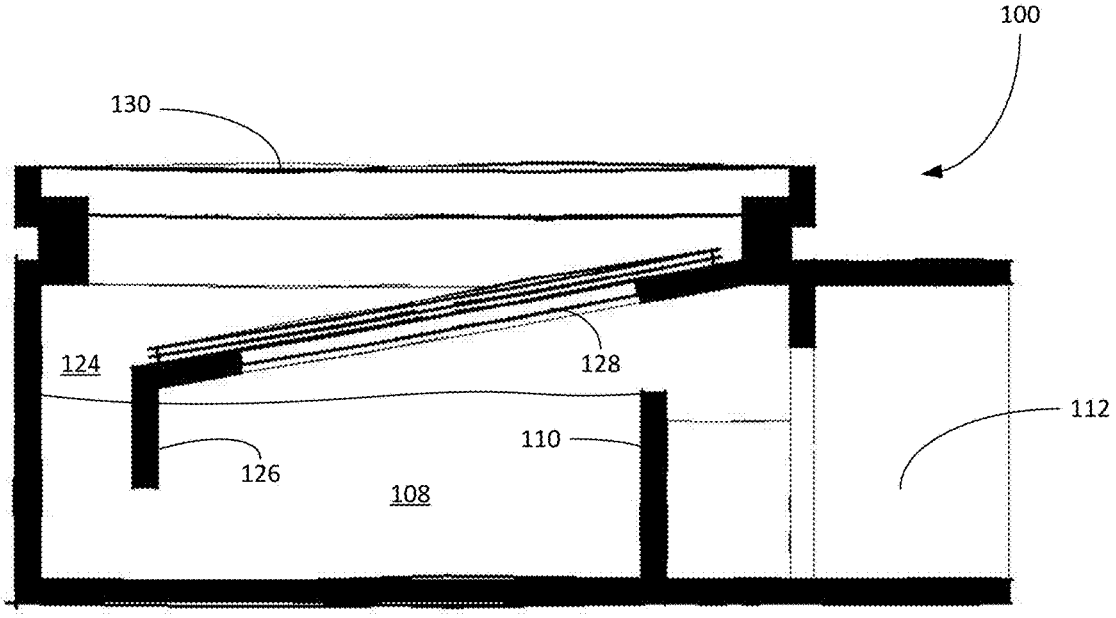
FIG. 10 is a cross-sectional view of the water trap of FIG. 9.
Figure 11:
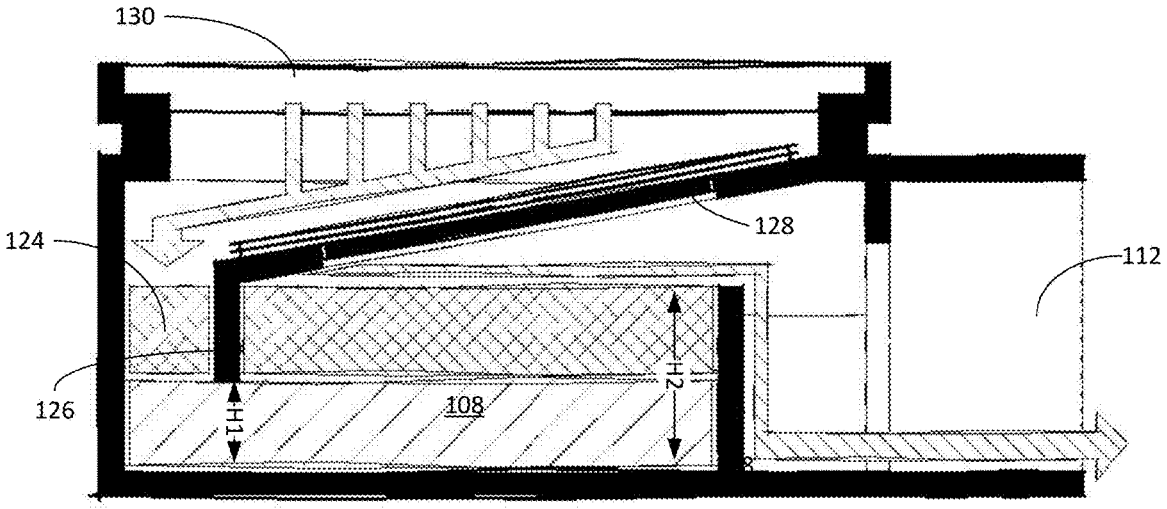
FIG. 11 is a cross-sectional view of the water trap of FIG. 9.
Figure 12:
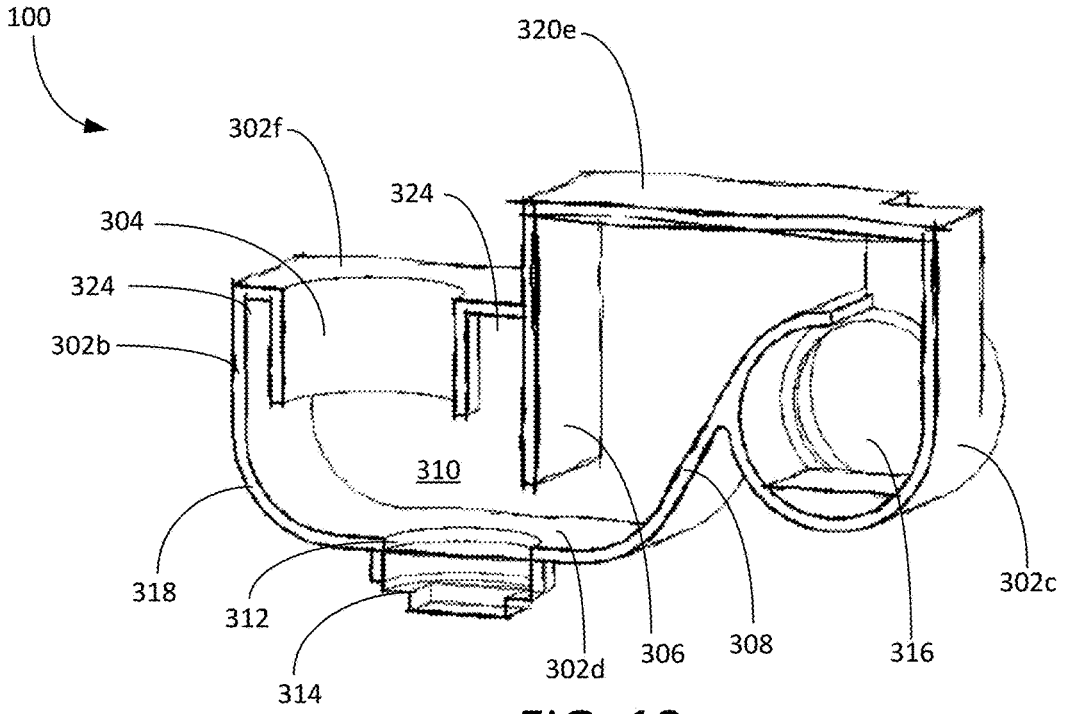
FIG. 12 is a cross-sectional perspective view of a water trap constructed in accordance with a fourth embodiment of the present invention.

FIG. 6 presents a second embodiment of the water trap 100 in which the water trap 100 is made an integral part of the wash basin 102. In this second embodiment depicted in FIG. 6, the inlet 106 is replaced by an intake channel 124, an inlet baffle 126 and a deflector plate 128. The deflector plate 128 may be integrated into the bottom of the wash basin 102 and is declined to encourage liquids to flow into the intake channel 124. The intake channel 124 can be covered by an overhanging portion of the wash basin 102 (as illustrated in FIG. 6). In other embodiments, the intake channel 124 is exposed. The inlet baffle 126 extends downward from a distal end of the deflector plate 128 into the water trap 100 and is suspended above the bottom 104*d* of the housing 104 by a height (h1). In this way, the lower portion of the inlet baffle 126 is submerged in the liquid retained within the trap chamber 108. This prevents sewer gases in the water trap 100 from escaping through the intake channel 124. In some embodiments, portions of the lower end of the inlet baffle 126 are connected to the bottom 104*d* of the housing 104, with designated cutouts below the water line within the trap chamber 108. If the water trap 100 becomes clogged, the trap chamber 108 can be easily accessed by removing the plug 120 from the cleanout port 114.

Turning to FIGS. 7-11, shown therein is a third embodiment of the water trap 100 configured for installation as a floor drain. In this embodiment, an exterior grate 130 is used to cover the deflector plate 128, which is connected to the inlet baffle 126. The grate 130 can be installed such that it is flush or level with the floor. The water trap 100 is located under the floor and connected to drain piping (not shown). The inlet baffle 126 is substantially vertically oriented and connected to a distal end of the deflector plate 128. In this embodiment, the intake channel 124 is formed between the inlet baffle 126 and the outer end wall of the housing 104. The exterior grate 130 is designed to allow liquids to pass into the water trap 100, while supporting the weight of a person or heavy objects.

The deflector plate 128 is disposed with an angular declination that encourages liquids to flow downward toward the intake channel 124. In some embodiments, the proximal end of the deflector plate 128 is hinged to permit the deflector plate 128 to be raised into an open position without removing the deflector plate 128. In other embodiments, the deflector plate 128 is secured within the water trap 100 with screws or other fasteners. In yet other embodiments, the deflector plate 128 is simply sized and configured to be held in place by gravity on a supporting frame structure within the water trap 100. The deflector plate 128 optionally includes recessed grooves that encourage flow into the trap chamber 108.

During use, liquids fall downward through the exterior grate 130 and are captured by the deflector plate 128, which directs the liquids toward the intake channel 124. The liquids falling through the intake channel 124 pass under the inlet baffle 126 to enter the trap chamber 108. As with the other embodiments disclosed herein, the liquid fills the trap chamber 108 and then passes over the weir 110 to exit the water trap 100 through the outlet 112. Liquid trapped inside the trap chamber 108 following a drain cycle prevents sewer gases from passing under the lower end of the inlet baffle 126, which remains submerged in the liquid retained in the trap chamber 108. If the water trap 100 becomes clogged, the exterior grate 130 and deflector plate 128 can be easily removed or opened to provide access to the internal portions of the water trap 100. This also facilitates removal of any items that were unintentionally dropped through the exterior grate 130.

Figure 13:
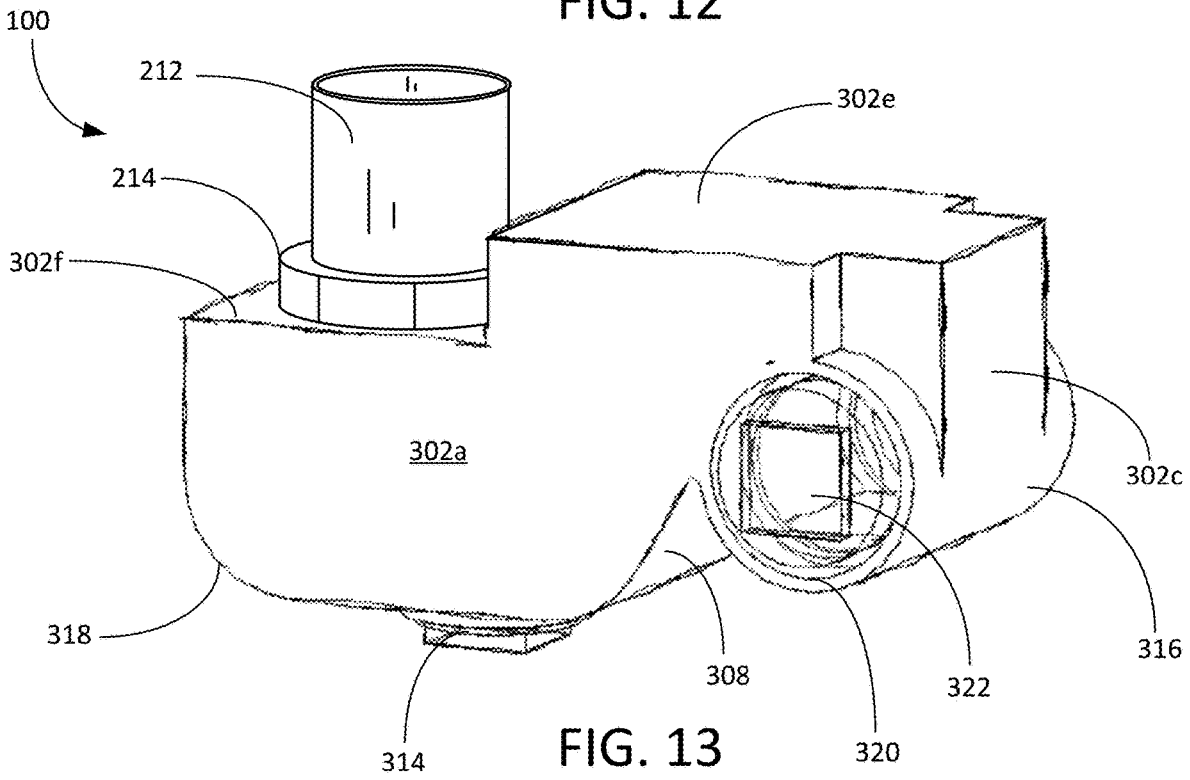
FIG. 13 is a perspective depiction of the water trap of FIG. 12.
Figure 14:
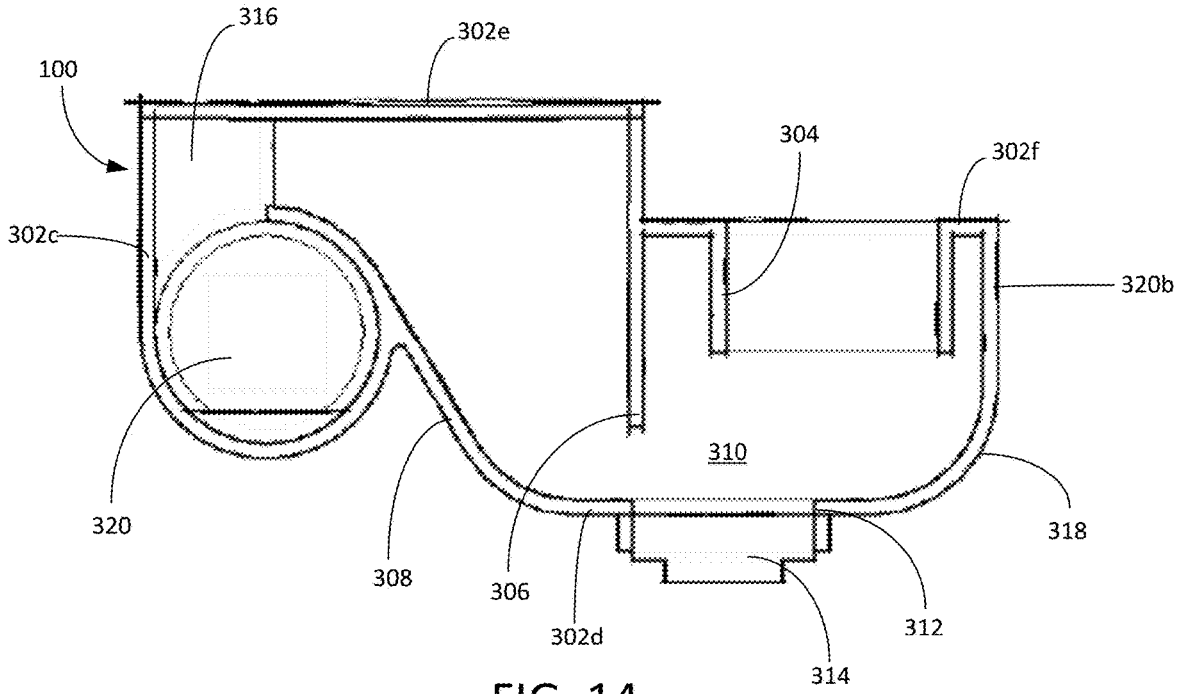
FIG. 14 is a side cross-sectional view of the water trap of FIG. 12.

Turning to FIGS. 12-18, shown therein is yet another embodiment of the water trap 100. In the embodiment depicted in FIGS. 12-17, the water trap 100 includes a housing 302, an inlet 304, an inlet baffle 306, a sloped outlet weir 308, an internal trap chamber 310, a cleanout port 312, a cleanout plug 314, and a dual horizontal outlet 316. The housing 302 includes sides 302*a*, an inlet end 302*b*, an outlet end 302*c*, a bowl-shaped bottom 302*d*, an outlet top 302*e*, and an inlet top 302*f*. The inlet top 302*f* is stepped down (lower) than the outlet top 302*e* so that the inlet 202 from the fixture drain pipe 212 from the fixture 210 can be secured to the inlet 304 of the water trap 100 with a fitting 214, as depicted in FIG. 13. In some applications, the inlet 304 includes a threaded portion (not shown) that engages the fitting 214 such that tightening the fitting 214 compressively retains the fixture drain pipe 212 within the inlet 304. The stepped down inlet top 302*f* permits the raised output top 302*e* to be secured directly, or closer, to the bottom of the fixture 210.

The cleanout port 312 port is located in the bowl-shaped housing bottom 302*d*. The cleanout plug 314 can be removed from the cleanout port 312 to gain access to the trap chamber 310. The bowl-shaped housing bottom 302*d* includes a rounded end 318 on the inlet-side of the water trap 100. The rounded end 318 encourages the efficient removal of liquids and particulates from the water trap 100. The bowl-shaped housing bottom 302*d* transitions along a common slope to the outlet weir 308 adjacent the outlet-side of the water trap 100. The outlet weir 308 terminates at the top of a dual-sided outlet 316. The interior space between the top of the outlet weir 308 and the inlet 304 defines the trap chamber 310.

The inlet baffle 306 extends downward from the inside of the housing outlet top 302*e* into the trap chamber 310. The bottom of the inlet baffle 306 is spaced apart from the bowl-shaped housing bottom 302*d* by a height (h3), which is less than the vertical distance (h2) between the top of the sloped outlet weir 308 and the housing bottom 302*d*. The distance (h3) between the housing bottom 302*d* and the bottom of the inlet baffle 306 is also less than the vertical distance (h1) between the bottom of the inlet 304 and the housing bottom 302*d*. This ensures that the bottom of the inlet baffle 306 remains submerged in liquid within the trap chamber 310.

Figure 15:
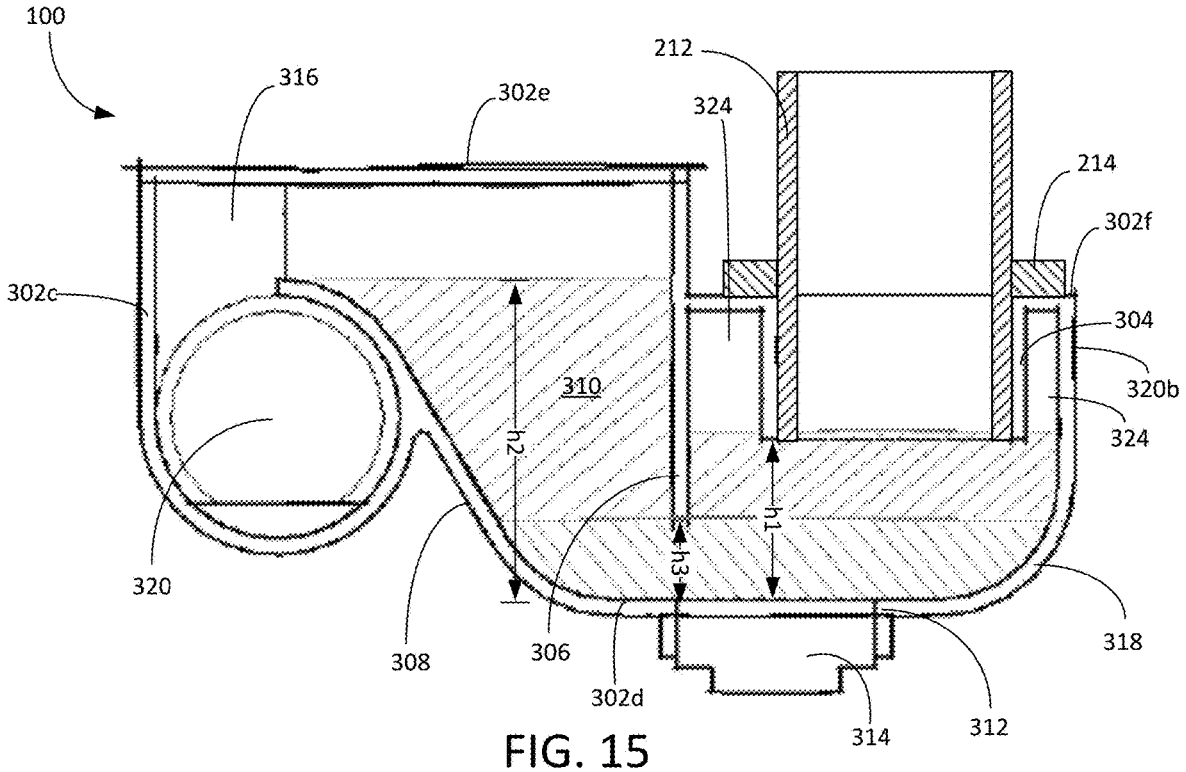
FIG. 15 is a side cross-sectional view of the water trap of FIG. 12.
Figure 16:
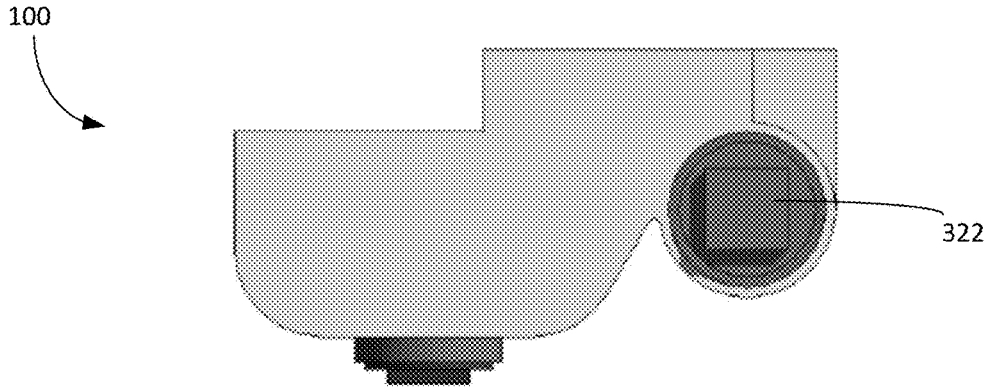
FIG. 16 is a right side view of the water trap of FIG. 12.
Figure 17:
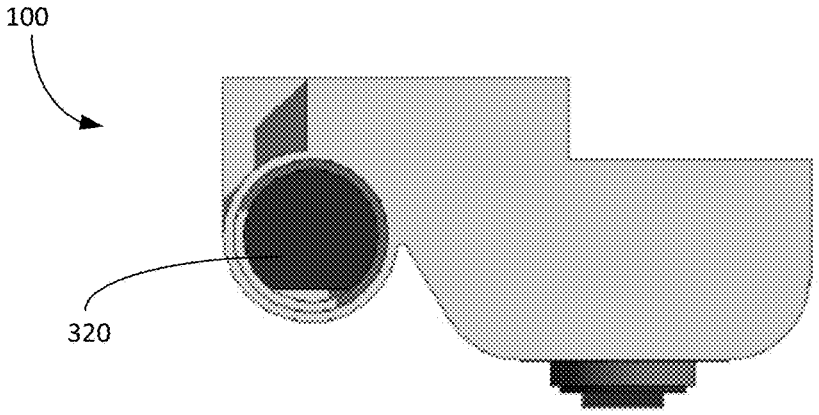
FIG. 17 is a left side view of the water trap of FIG. 12.

The space between the inlet baffle 306 and the inlet 304 creates an air pocket 324, which increases in pressure as the fluid level in the trap chamber 310 rises. As illustrated in FIG. 15, the pressurized air in the air pocket 324 lowers the liquid level on the inlet side of the inlet baffle 306 compared to the liquid level on the outlet side of the inlet baffle 306 (which is typically exposed to atmospheric pressure through the discharge ports 320). In this way, the air pocket 324 reduces the risk of liquid backing up into the inlet 304, which improves the performance of the water trap 100 and permits the use of shallower trap chambers 310.

Figure 18:
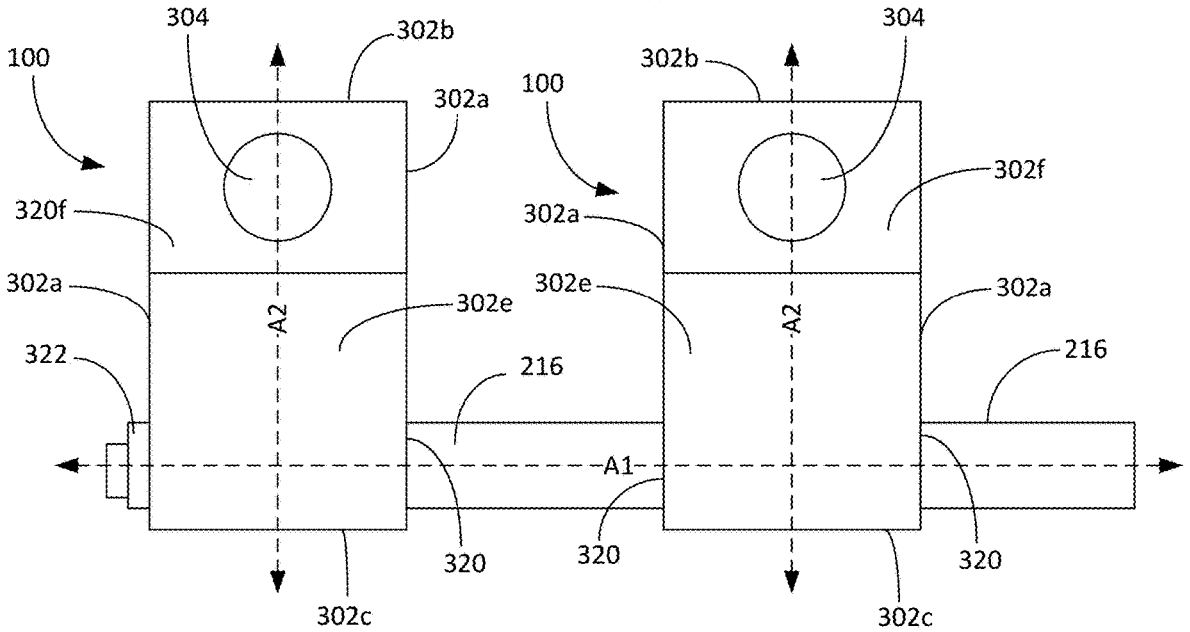
FIG. 18 is a top view of two water traps ganged together.

As depicted in FIG. 18, the dual-sided outlet 316 includes two discharge ports 320 on opposite sides of the water trap 100. The dual-sided outlet 316 is oriented along a lateral axis (A1) that is substantially orthogonal to the general longitudinal axis (A2) that runs along the length of the water trap 100 from the inlet 304 to the outlet 316. Each of the discharge ports 320 is configured for connection with upstream or downstream discharge piping. In this way, two or more water traps 100 can be connected or "ganged" to one another by connecting a trap discharge pipe 216 between the discharge ports 320 on adjacent water traps 100. If one of the discharge ports 320 is not connected to a trap discharge pipe 216, a discharge plug 322 can be used to seal that discharge port 320. Thus, the dual-sided outlet 316 permits the use of multiple water traps 100 along a common drain line, which has particular application for installations involving multiple sinks, drains or other fixtures 210. The laterally-oriented discharge ports 320 also facilitates connecting the trap discharge pipe 216 to downstream drain piping, particularly in shallow installations where there is limited space between the water trap 100 and the wall along the general longitudinal axis (A2). The ability to easily remove the discharge plug 322 also provides access to the downstream drain piping through the trap discharge pipe along the lateral axis (A1).

While the present disclosure has been described in connection with certain embodiments so that aspects thereof may be more fully understood and appreciated, it is not intended that the present disclosure be limited to these particular embodiments. On the contrary, it is intended that all alternatives, modifications and equivalents are included within the scope of the present disclosure. Thus, the examples described above, which include particular embodiments, will serve to illustrate the practice of the present disclosure, with it being understood that the particulars shown are by way of example and for purposes of illustrative discussion of particular embodiments only and are presented in the cause of providing what is believed to be the most useful and readily understood description of procedures, as well as of the principles and conceptual aspects of the presently disclosed methods and compositions. Changes may be made in the structures of the various components described herein, or the methods described herein without departing from the spirit and scope of the present disclosure.

It is claimed:

1. A water trap for use in connection with a wash basin or other plumbing fixture, the water trap comprising:
- a housing, wherein the housing comprises:
  - a top;
  - a bottom;
  - a plurality of side walls; and
  - a plurality of end walls;
- an inlet extending into the housing;
- an outlet extending out of the housing;
- a weir inside the housing between the inlet and the outlet;
- a trap chamber defined by the space within the housing on an upstream side of the weir, wherein the trap chamber is designed to retain liquid following a drain cycle from the wash basin or other plumbing fixture; and
- an inlet baffle extending downward from the top of the housing into the trap chamber; and
- an air pocket between the inlet baffle and the inlet, wherein the air pocket contains pressurized air during use.

2. The water trap of claim 1, wherein the inlet includes a discharge end that is configured to be submerged within the liquid retained within the trap chamber.

3. The water trap of claim 1, further comprising:
- a cleanout port that provides access to the trap chamber; and
- a removable plug connected to the cleanout port.

4. The water trap of claim 1, wherein the inlet includes a discharge end that is spaced above the bottom of the housing at a first height (h1); and wherein the weir extends upward from the bottom of the housing to a second height (h2).

5. The water trap of claim 4, wherein the second height (h2) is greater than the first height (h1), such that the discharge end of the inlet is located closer to the bottom of the housing than an upper portion of the weir.

6. The water trap of claim 5, wherein the outlet is a dual-sided outlet that includes a pair of discharge ports aligned along a lateral axis that is substantially orthogonal to a longitudinal axis extending between the plurality of end walls.

7. The water trap of claim 1, wherein the housing includes a funnel section proximate to the outlet and downstream from the weir.

8. The water trap of claim 1, wherein the inlet is substantially vertical and the outlet is substantially horizontal.

9. A water trap for use in connection with a floor drain, the water trap comprising:
- a housing;
- an exterior grate on the top of the housing;
- a deflector plate under the exterior grate;
- an inlet baffle connected to a distal end of the deflector plate;
- an intake channel between the inlet baffle and the housing;
- an outlet extending from the housing;
- a weir inside the housing between the inlet baffle and the outlet; and
- a trap chamber defined by the space within the housing on an upstream side of the weir, wherein the trap chamber is designed to retain liquid following a drain cycle from the floor drain; and
- wherein the deflector plate is removable to provide access to the trap chamber located under the deflector plate.

10. The water trap of claim 9, wherein a lower end of the inlet baffle is configured to be submerged within the liquid retained within the trap chamber.

11. The water trap of claim 9, wherein the housing includes a bottom, a plurality of ends and a plurality of sides.

12. The water trap of claim 11, wherein the lower end of the inlet baffle is spaced above the bottom of the housing by a first height (h1).

13. The water trap of claim 12, wherein the weir extends above the bottom of the housing by a second height (h2) that is greater than the first height (h1).

14. A water trap for use in connection with a floor drain, the water trap comprising:
- a housing;
- an exterior grate on the top of the housing;
- a deflector plate under the exterior grate;
- an inlet baffle connected to a distal end of the deflector plate;
- an intake channel between the inlet baffle and the housing;
- an outlet extending from the housing;
- a weir inside the housing between the inlet baffle and the outlet;
- a trap chamber defined by the space within the housing on an upstream side of the weir, wherein the trap chamber is designed to retain liquid following a drain cycle from the floor drain; and
- wherein the deflector plate is hinged to permit the deflector plate to be opened to provide access to the trap chamber located under the deflector plate.

* * * * *